US006034703A

United States Patent [19]

Broddin et al.

[11] Patent Number: 6,034,703

[45] Date of Patent: Mar. 7, 2000

[54] PROCESS CONTROL OF ELECTROPHOTOGRAPHIC DEVICE

[75] Inventors: Dirk K. Broddin, Edegem; Jean-Pierre J. Slabbaert, Boechout; Frank A. Deschuytere, Beveren; Robert F. Janssens, Geel; Werner F. Heirbaut, Sint-Niklaas, all of Belgium; William E. Nelson, Dallas, Tex.; Venkat V. Easwar, Cupertino, Calif.

[73] Assignees: Texas Instruments Incorporated, Dallas, Tex.; Agfa-Gevaert N.V., Mortsel, Belgium

[21] Appl. No.: 09/010,780

[22] Filed: Jan. 22, 1998

Related U.S. Application Data

[63] Continuation of application No. 08/791,061, Jan. 29, 1997

[60] Provisional application No. 60/037,006, Jan. 31, 1997.

[51] Int. Cl.[7] ..... B41J 2/385; G03G 13/04; G03G 15/00

[52] U.S. Cl. ..... 347/131; 399/46; 399/49

[58] Field of Search ..... 347/131, 240, 347/251; 399/38, 46, 48, 44, 49, 50, 51; 358/298

[56] References Cited

U.S. PATENT DOCUMENTS

| | | | |
|---|---|---|---|
| 5,194,878 | 3/1993 | Murakami et al. | 347/131 X |
| 5,237,369 | 8/1993 | Maruta et al. | 399/49 |
| 5,274,424 | 12/1993 | Hattori et al. | 399/49 |
| 5,309,177 | 5/1994 | Shoji et al. | 347/131 |
| 5,485,191 | 1/1996 | Gu | 347/131 |
| 5,808,651 | 9/1998 | Horiuchi | 347/131 |

*Primary Examiner*—Sandra Brase
*Attorney, Agent, or Firm*—Charles A. Brill; Frederick J. Telecky, Jr.; Richard L. Donaldson

[57] ABSTRACT

A method is described to control the maximum density and the pixel profile of microdots produced by a binary or multilevel electrophotographic device. In various embodiments, from the maximum development potential. The working point of the device is established by imposing a relation between charge level, discharge level and saturation voltage level of the photosensitive element. This allows to achieve consistent output densities, irrespective of the environmental parameters, such as relative humidity and temperature.

7 Claims, 8 Drawing Sheets

PROCESS CONTROL OF ELECTROPHOTOGRAPHIC DEVICE

DESCRIPTION

This application claims priority under 35 U.S.C. Section 199(3)(1) of Prov. Appl. 60/037,006 filed Jan. 31, 1997. Continuation-in-part of prior application Ser. No. 08/791,061, filed Jan. 29, 1997.

FIELD OF THE INVENTION

The present invention relates to devices and methods for hardcopy printing. More specifically the invention is related to a hardcopy device that has an exposure subsystem that is responsible for the generation of a latent image on a photosensitive medium. This medium may be the final image carrier after development or alternatively an intermediate member, where the latent images are developed using developers of the appropriate colours and where the developed sub-images are transferred to the final substrate as is the case in electrophotography.

More specifically, the present invention relates to devices and methods for an image forming apparatus, such as an electrophotographic digital copying machine or digital printer with a two-component development system.

BACKGROUND OF THE INVENTION

Various electronic devices are available on the market that transform a digital or electronic image to appropriate density variations on an image carrier, in order to render the electronic image visible on the image carrier. Alternatively, the electronic image is converted to an image-wise distribution of ink repellant and ink accepting zones on a printing plate, for use in e.g. offset printing.

An electronic image is typically represented by a rectangular matrix of pixels, each having a pixel value. The location of each pixel within the matrix corresponds to a specific location on the image carrier. Each pixel value corresponds to an optical density required on the image carrier at the specific location.

In a binary system, two pixel values, e.g. 0 and 1, are sufficient, to represent a high density and a low density, which may be obtained by applying ink and no ink respectively, or toner and no toner, or generating locally dye or no dye, or by keeping and removing silver in a photographic process. In the production of printing plates, 0 may result in an ink repellant zone, where 1 results in an ink accepting zone.

In a continuous tone system, multiple density levels may be generated on the image carrier, with no perceptible quantisation to them. In order to achieve such fine quantisation, usually 256 different density levels are required, such that each pixel value may range from 0 to 255. In electrophotography usually a reduced number of density levels can be generated consistently, e.g. 16 levels, in which case the system is called a multilevel system, as opposed to a binary system or a continuous tone system.

As said before, each "zone" or "microdot" on the image carrier gets a density, corresponding to a pixel value from the electronic image. Such zone is further on indicated by the term "microdot". A microdot is the smallest space on the image carrier that can get an optical density (or ink repellency) different from neighbouring locations. Usually microdots are represented by squares or rectangles within parallel and orthogonal grid lines. The spacing of the grid lines is indicative for the resolution of the output device.

For each microdot on the image carrier, one pixel value is required. In an output device, based on image generation by exposure to light, the microdots are usually illuminated sequentially one at a time by (one or more) scanning laser beams. Microdots may be illuminated one row at a time, as with emitting LED bars or through spatial light modulators like liquid crystal (LCD) shutters or digital mirror devices (DMD).

A typical laser scanner example is the Agfa P3400 laser printer, marketed by Agfa-Gevaert N. V., which is a 400 dpi (dots per inch, one inch is 25.4 mm) printer. Each microdot has approximately a size of 62 $\mu$m. The diameter of the circular spot is typically 88 $\mu$m. This means that within a radius of 44 $\mu$m the illuminance (W/m$^2$) of the light beam is everywhere higher than 50% of the maximum illuminance. The illumination is usually nearly Gaussian distributed. This means that the illuminance is maximal in the centre of the microdot or in the centre of the circular spot, and decays as the distance from this centre increases. In some systems, an elliptical spot is preferred above a circular spot. Usually, the short axis of the ellipse is oriented along the fast scan direction of the laser beam, to compensate for the elongation of the illumination spot as the beam moves during the finite exposure times.

A typical LED exposure example is the Agfa P400 laser printer, marketed by Agfa-Gevaert N. V., which is equally a 400 dpi (dots per inch) printer and has an extension of the spot of typically 88 $\mu$m.

In an electrophotographic system, multilevel exposure at the microdot level is used to reduce tone gradation coarseness at a given screen ruling associated with the limited addressability. Exposure intensity at the pixel level is varied and the operation point on the discharge curve is chosen such as to have a nearly linear discharge behaviour as a function of exposure for most of the exposure range used.

Because of the smooth gradation response of the photosensitive medium, for which preferentially the conductivity varies when photons impinge on its surface, e.g. an organic photoconductor (OPC), an essentially uniform energy distribution within the microdot is required. Moreover, a suitable working point of the electrophotographic process is required. This working point is characterised by parameters which are discussed in detail below.

One of the main factors to quantify the quality of a printed image is the tone scale representation, expressed by the optical density range and the exactness and stability of the contone rendering. In a digital printing machine, such as an electrophotographic engine, each tone of a contone image is produced by a certain spatial combination of some or all of the available tones per pixel. This process is referred to as screening. The set of tones, available in the machine, is defined by the properties of the exposure device. For instance, in an electrophotographic printer that uses a binary exposure device, only two tones (black and white) are available to the screening algorithm to reproduce a contone image. In some machines however, multiple tone levels are available to the screening process by applying area or intensity modulation on the output spot of the exposure device (see below). As screening is well-defined and, by its nature, perfectly repeatable, the image quality of the engine is largely determined by the ability to reproduce the set of tones. In an electrophotographic engine the contone density of each microdot is determined by the mass of toner per unit area transferred to paper. This toner mass, referred to as M/A and expressed in mg/cm$^2$, is a function of an almost limitless amount of parameters. Most of these parameters can be regarded as fixed by design and thus invariable during the operation of the engine. Some however are extremely variable. The most important in a two-component developer system are:

- toner concentration (TC)=the ratio of the amount of toner and the amount of carrier available in the developing unit in a two-component system.
- toner charge per unit of mass (Q/M), expressed in $\mu$C/g. development potential ($V_{DEV}$), expressed in Volt=the potential difference $V_E$-$V_B$ over the development gap between the developer supply roller (bias voltage $V_B$) and the photosensitive element (voltage after exposure $V_E$) upon which a latent image is present. The photosensitive element is mostly implemented as an Organic Photoconductor or OPC.
- transfer efficiency (TE), expressed in %: the ratio of the amount of toner transferred to the printing medium and the amount of toner developed on the photosensitive element. This dependency can be formally expressed as:

$$M/A=f\ (\ TC,\ Q/M,\ V_{DEV},\ TE\ )$$

and is generally referred to as the develop ability and transferability of the toner.

In an electrophotographic engine, the reproduction of multiple tones is highly sensitive to each of these variables. Toner concentration TC changes during engine operation due to depletion of toner caused by image development and toner addition under control of the engine. Toner charge Q/M is determined by:

- the triboelectric properties of toner and carrier,
- toner concentration TC,
- relative humidity RH of the air in the developing unit,
- agitation of developer in the developing unit.

When the developer is properly agitated, an unambiguous relationship can be found between Q/M, TC and RH. The development potential $V_{DEV}$ is determined by:

- the initial charge level $V_C$ of the OPC,
- the bias voltage $V_B$ applied to the toner supply roller of the developing unit and
- the intensity $E_{EXP}$ of the image dependent illumination of the photosensitive element.

Transfer efficiency TE on its turn is, amongst other factors, determined by:

- toner charge Q/M,
- amount of toner on the photosensitive element and
- the value of the electric field in the transfer zone.

Present electrophotographic machines maintain the optical density of their produced tones by keeping toner concentration TC at a constant level. For this purpose they use a toner concentration sensor in the developing unit, or a density sensor that measures the density $D_{OPC}$ developed on the OPC, or both. Changes of the toner charge Q/M, due to relative humidity RH or variations of RH are compensated for by changing the development potential $V_{DEV}$ and the value of the transfer electric field. Disadvantages of this technique are:

- extremely low toner charge Q/M at high relative humidity RH, leading to an increase in dust production, fogging and possibly inconsistent transfer quality over the whole tone scale.
- extremely high toner charge at low relative humidity, decreasing the develop ability of the toner. This requires large electric fields in the developing stage and consequently implies more powerful engine hardware.

Furthermore, it can be shown that for a two-component developing system, the development of the latent image is almost purely driven by toner charge Q/M. Therefore toner charge Q/M would be a valuable input to any process control system for steering the electrophotographic process. Generally, online toner charge measurement Q/M can not be implemented easily without the need for high precision measurement hardware, which leads to an increase in system variable cost. As stated before, producing several tones in an electrophotographic engine can be done by area modulation or by intensity modulation of the light beam of the exposure device (or by any combination of both). In this way, a set of microscopic tones at the pixel or microdot level are created. These form a microscopic gradation that has to be kept constant for the contone rendering, handled by the screening process, to be repeatable. The relation between the modulated output $E_{EXP}$ of the exposure device and the resulting development potential $V_{DEV}$ is extremely non-linear. Worse due to the necessary cleaning potential $V_{CL}$ (difference between charge potential $V_C$ and bias potential $V_B$), there is always a range in the exposure intensity $E_{EXP}$ where no development potential $V_{DEV}$ is created. The exposure energy $E_{EXP}$ has to exceed a certain threshold before any development occurs. As explained above, due to changes in the develop ability of the developer (Relative Humidity RH, developer age, etc.), the development potential $V_{DEV}$ has to be changed in order to maintain the proper image density D. This implies changing the charge potential $V_C$ and the bias potential. By doing this, the relationship between output energy $E_{EXP}$ of the exposure device and the resulting development potential $V_{DEV}$ is altered, causing a dramatic change on the microscopic gradation D. The modulation function, used for converting tone levels I of the original image to exposure energy $E_{EXP}$ levels has to be redefined. In present electrophotographic machines a global linear shift and/or resealing is applied to the exposure modulation function (I, $E_{EXP}$), see for instance U.S. Pat. No. 5,305,057. Because of the non-linearity and the threshold phenomenon described above, this is clearly not enough in order to maintain the highest possible contone fidelity. There is still another effect that one has to consider when producing images in a digital electrophotographic engine. Present electrophotographic engines maintain the discharge potential $V_E$ or the potential of the OPC after exposure at maximum exposure (=maximum density) at one predefined level. Changes in develop ability will require other development potentials $V_{DEV}$ and thus other charge potentials $V_C$. Keeping the discharge level $(E_{EXP})_{MAX}$ at the same point will consequently put the point of maximum exposure at a different point of the sensitometric curve of the OPC. The non-linear behaviour of this sensitometric curve will cause the shape of individual pixels to change dramatically due to the saturation effect. This changes individual pixel sizes and the contone rendering created by the screening process. FIG. 11 and FIG. 12 illustrate the above described effects. FIG. 11 shows two discharge curves for a typical OPC: one curve 50 for a high charge voltage $V_C$=−440 V needed at low humidity, RH=30%, the second curve 51 for a lower charge voltage $V_C$=−330 V needed at high humidity, RH=70%. The horizontal line 52 indicates the constant discharge potential $(V_E)_{MAX}$ for maximum exposure. On the horizontal $E_{EXP}$-axis, the corresponding maximum exposure energy level $E_{MAX}$ for the respective humidity levels RH are found. FIG. 12 shows the resulting pixel profiles in deposited mass M/A in mg/cm$^2$ for an exposure device with a typical gaussian spot. The maximum intensity or energy level of the spot is given by the respective $E_{MAX}$ values from FIG. 11. The graph 53 shows the pixel profile that corresponds with a low relative humidity RH=30%. The graph 54 shows the pixel profile that corresponds with a high relative humidity RH=70%. From the graph it is clear that the change in pixel size is not negligible.

OBJECTS OF THE INVENTION

It is therefore a first object of the invention to provide methods and devices for halftone image printing with improved tone scale linearity for electrophotographic systems, wherein a required density is achieved.

It is yet another object of the invention to provide a method for defining the operating point of the engine in such a way that the contone rendering made available through the screening process is kept stable and repeatable.

Further objects of the invention will become apparent from the description hereinafter.

SUMMARY OF THE INVENTION

The above mentioned objects are realised by the specific features according to claim 1. Specific features for preferred embodiments of the invention are set out in the dependent claims.

These objects can be accomplished according to the present invention by an electrophotographic image forming apparatus as shown in FIG. 1. This apparatus comprises a charging device 2, such as a scorotron, that charges a photosensitive element 1, such as an Organic Photo conductor (OPC). The charged photoconductor 1 is exposed by an exposure device 3. such as a LASER, an LED-array, a spatial light modulator (like a DMD: deflective mirror device) etc., to form a latent image. The latent image is developed by a two-component developing system to form a toner image. The toner image is transferred to an output medium 22 such as paper or transparency and fused by applying heat and/or mechanical pressure. The apparatus preferentially comprises a densitometer 6 that measures the optical density D of the image developed on the OPC, preferably to correct the developing process for possible deviations. The apparatus preferably contains a contact-less electrostatic voltage sensor 4 that measures the surface potential of the OPC 1. The apparatus preferably also contains a toner concentration sensor 16, preferentially located in the developing system 5. The developability and transferability of the toner particles are maintained over the complete range of environmental conditions, developer lifetime, etc. by keeping the charge of the toner, Q/M, within a narrow range. This range is defined by the unambiguous relationship between Q/M, TC and RH and the range for TC that can be allowed without penalizing developer lifetime. By changing the toner concentration TC by means of toner addition or toner depletion during operation of the engine, toner charge Q/M can be maintained at its required level. Toner charge Q/M may be indirectly measured, based upon the unambiguous relationship that exists between M/A, Q/M and $V_{DEV}$, for that range of M/A where development is not limited by toner supply (low- and midtones). The operating point of the engine (charge level $V_C$, exposure intensity $E_{MAX}$ at maximum density, cleaning potential $V_{CL}$) is calculated in such a way that possible line width increase is taken into account. Proper microscopic gradation $D_i$ is maintained by re-positioning each exposure level $E_{EXP}$, relating to a microscopic tone, along the complete range of available output energy levels $E_{EXP}$, every time the $D_i$ operating point of the engine is changed.

Further advantages and embodiments of the present invention will become apparent from the following description and drawings.

BRIEF DESCRIPTION OF THE DRAWINGS

The invention is described hereinafter by way of examples with reference to the accompanying figure wherein.

DETAILED DESCRIPTION OF THE INVENTION

Electrophotographic engine

Figure 1:
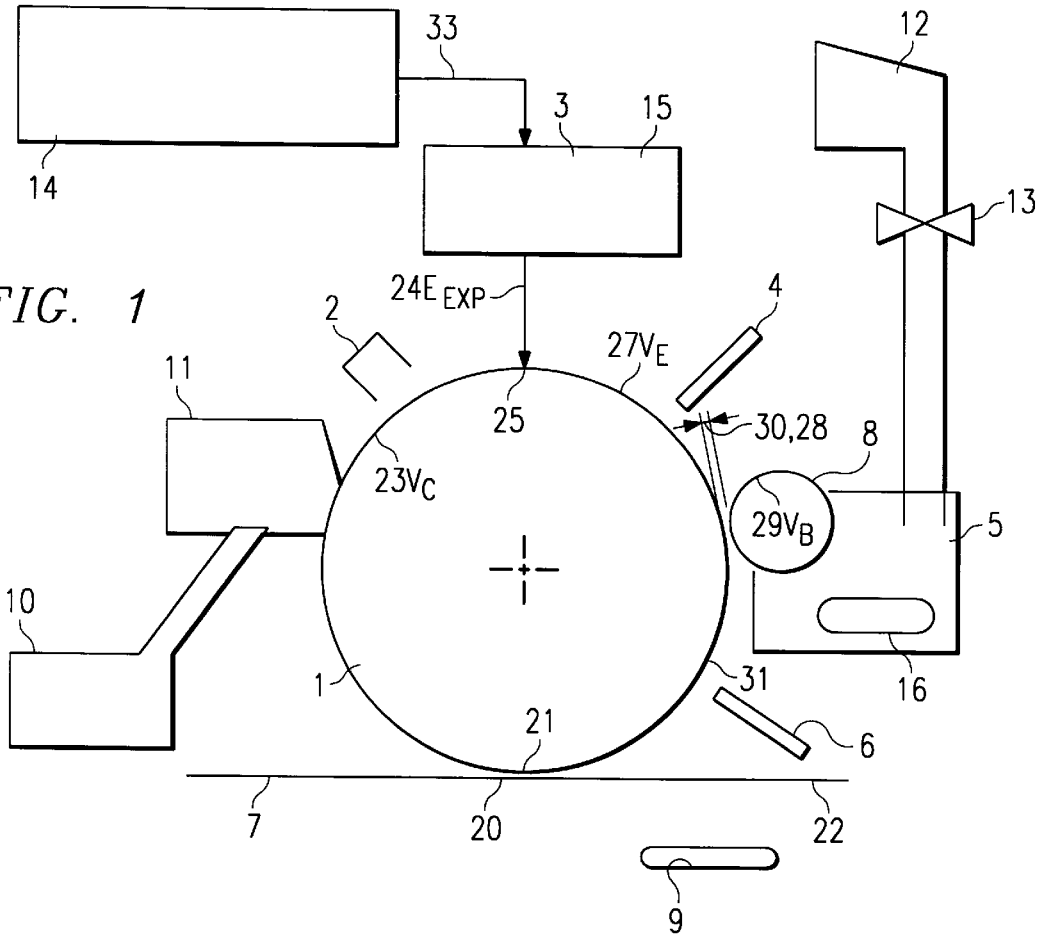
FIG. 1 represents an electrophotographic engine suitable for the current invention

The most important components of an electrophotographic imaging apparatus suitable for the current invention are shown in FIG. 1. A photosensitive element 1, such as an OPC, is charged by a charging device 2 (such as a scorotron) and exposed by an exposure device 3 (laser scan system, LED-array, DMD, etc.). The exposure device 3 is capable of generating more than one exposure energy level $E_{EXP}$ per pixel. For instance a binary device can image two levels (0 and some other level different from 0), a 16-level (4 bit/pixel information) exposure device can generate 16 distinguishable levels per pixel (including 0), etc. The exposure device 3 receives image data 33 from an image processing unit 14, generally called a RIP or Raster Image Processor, which translates image data, presented in a page description language, to a bitmap. The bitmap contains the required exposure tone level I for each pixel in the image. Inside the exposure device 3 there is preferably a translation table 15 (look-up-table or LUT) to translate the data in the bitmap to physical exposure energy levels $E_{EXP}$. The effect of charging to a charge voltage $V_C$ and subsequently discharging by exposure $E_{EXP}$ can be measured by a contact-less electrostatic voltage sensor 4. The resultant latent image is developed by a two-component developing system 5. Charged toner particles are transferred from the magnetic brush 8 to the OPC surface by the force of the electric field $V_{DEV}$ present between the OPC surface at potential $V_E$ and the surface of the magnetic roller at potential $V_B$. The density $D_{OPC}$ 31 of the developed image can be measured with a densitometer 6 focused on the OPC surface. The engine comprises a toner container 12 from which toner can be added to the developing unit 5 through a control means 13. The developing unit 5 further preferably contains a toner concentration sensor 16 which is merely used as a watchdog for detecting extreme toner concentration values. The toner image is transferred to a medium 7 (paper, transparency, etc.). The engine also contains an environmental sensor 9 (referred to as RH/T sensor) that senses both relative humidity RH and temperature T. Toner particles that are not transferred to the medium 7 are scraped from the OPC by a cleaner system 11 and dumped into the toner waste box 10.

Figure 2:
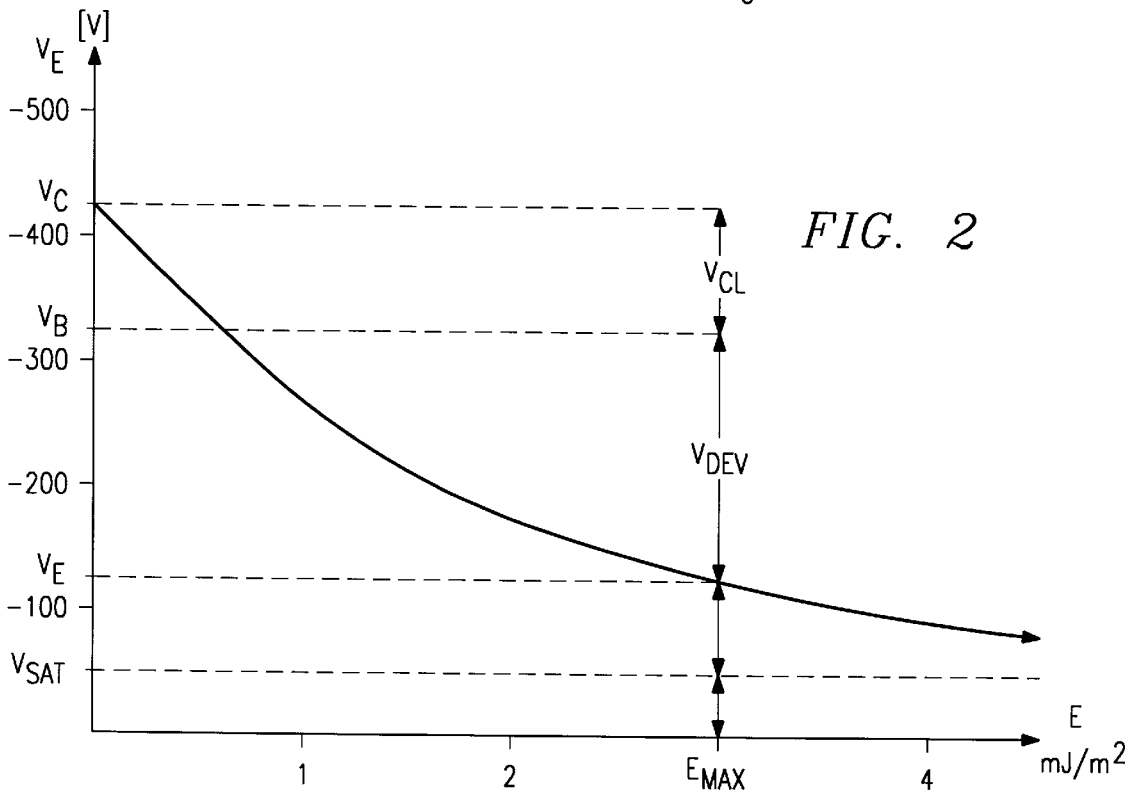
FIG. 2 shows the potential $V_e$ at the surface of an OPC, suitable for the current invention, after exposure E of the OPC. $V_e$ is plotted against E.

In order to facilitate the concepts to follow, a definition of potentials, voltages and terms is given, in conjunction with FIG. 1 and FIG. 2. All potentials are referred to the ground potential of the OPC (1).

$V_C$ charge potential (33): potential to which the OPC is brought by the charge station (2). In the example of FIG. 2, $V_C$ has a value of −425 Volt.

$V_e$ potential (27) after exposure E (expressed in mJ/m$^2$) of the OPC.

$V_E$ potential after maximal exposure $E_{MAX}$ of the OPC. The exposure E by a light source, such as a lamp or an LED, which impinges on the OPC, may be expressed in mJ/m$^2$. Maximal exposure $E=E_{MAX}$ of two neighbouring microdots may influence this potential $V_E$ after maximal exposure. A typical value for $V_E$ is −125 V. whereas a typical value for $E_{MAX}$ is 3 mJ/m$^2$.

$V_B$ bias voltage (29) between the developer subsystem (5) supplying the toner; and, the ground potential of the OPC (1).

A typical value for $V_B$ is −325 V, as shown in FIG. 2.

$V_{DEV}$ development potential=$V_E$-$V_B$. A typical voltage to achieve full development to solid toner is 325−125=200 V.

$V_{CL}$ cleaning potential=$V_B$-$V_C$. A typical value for repelling enough toner particles from a non-exposed area is 425−325=100 V. $V_{CL}$ is usually between 50 and 100 V $V_{SAT}$ saturation potential. This potential is shown on FIG. 2 and is defined by the asymptotic value for $E \rightarrow \leqq$ for the curve in FIG. 2, as indicated by the arrow.

Charge voltage $V_C$ and discharge voltage $V_e$ can be measured using a contact-less electrostatic voltmeter such as a TREK model number 856 (trademark of TREK Inc.), which is preferentially mounted towards the OPC surface.

The approach followed, to define the process parameters for the reversal development process, is described by reference to FIG. 2. In abscissa, the exposure energy level E is shown, expressed in mJ/m$^2$. In ordinate, the potential after exposure $V_e$ is shown, expressed in Volt and with reference to the saturation voltage $V_{SAT}$, the bias voltage $V_B$ and the charge potential $V_C$. The curve in FIG. 2 shows the discharge curve, which gives the potential $V_e$ on the OPC after exposure by an energy E. In normal operation, the exposure system is operated between 0 and $E_{MAX}$, such that the potential $V_e$ may vary between $V_C$ and $V_E$.

The process parameters shown in FIG. 2 are preferentially obtained in the following way. The saturation voltage $V_{SAT}$, or saturation exposure potential, is a system parameter, determined mainly by the OPC type, the processing speed, the engine geometry (clock position of charging (2) and development (5)) and erase lamp settings (fatigue). Once the building components of the system are defined, $V_{SAT}$ is fixed. A typical value for $V_{SAT}$ is −50 V.

Next $V_{CL}$ is determined for a given development system. The value for the cleaning potential $V_{CL}$ must be selected such that the fog level of the printing system is visually acceptable. If $V_{CL}$ is too low, then locations on the OPC having a voltage level of $V_C$ would not repel toner particles, resulting in fog on the printed document. On the other hand, selecting $V_{CL}$ too high gives other problems. A typical value for $V_{CL}$ is 100 V.

According to FIG. 2, two parameters may be further fixed: i.e. $V_{DEV}$ and $V_C$. By changing $V_C$, the shape of the curve as shown in FIG. 2 is changed. If $V_C$ is increased to a higher voltage, then the whole curve moves to a higher position, since its asymptotic value $V_{SAT}$ remains the same. If $V_C$ is decreased, the discharge curve moves to a lower position. In a first preferred embodiment, $V_C$ and $V_{DEV}$ must be selected such that the following two conditions are satisfied:

A. the required density $D_{MAX}$ or target full solid density development, being a design specification e.g. $D_{MAX}$=1.8 for black toner, is obtained on the printed material by exposure $E_{MAX}$, giving exposure voltage $V_E$; and,

B. $V_E=V_{SAT}-1/4\ (V_{DEV}+V_{CL})$

Values satisfying these two conditions may be found by an iterative procedure, which may go as follows. First a reasonable value for $V_C$ is selected, say $V_{C1}$. By subsequent exposure of the OPC, pre-charged at $V_{C1}$, by different exposure levels $E_J$. different values for $V_e$, i.e. $V_{e1J}$ are obtained. The exposure voltage $V_{e1J}$ depends not only on the exposure level $E_J$, but also on the charge potential $V_{c1}$, hence the index 1. By plotting $V_{e1J}$ as a function of $E_J$, a curve as shown in FIG. 2 is obtained. The system having charge potential $V_{C1}$ is now used to produce printed output. A suitable value for $E_{MAX}$ is selected, in order to produce a toner image. The optical density D of the toner image is measured and compared to $D_{MAX}$, the required highest density. If D is lower than $D_{MAX}$, then $E_{MAX}$ is increased, if D is higher than $D_{MAX}$, then $E_{MAX}$ is decreased, until a value for $E_{MAX}$ is found, suitable for producing the density $D_{MAX}$. From the curve in FIG. 2, given the suitable exposure level $E_{MAX}$, the corresponding value $V_E$ can be obtained. Alternatively, this value $V_E$ may be measured during printing printing $D_{MAX}$. Since $V_{C1}$ and $V_{CL}$ are fixed, $V_{DEV}$ may be computed. This value $V_{DEV}$ is used to assess the equation: $V_E=V_{SAT}-1/4\ (V_{DEV}+V_{CL})$ if this is approximately fulfilled, e.g. within 10% or preferably 5%, then the iteration stops and good values for both $V_C$ and $V_{DEV}$ have been found. Otherwise, the process may re-iterate, by selecting a new value for $V_C$, e.g.:

$$V_{C2}=V_{SAT}-5/4 * (V_{DEV}+V_{CL})$$

By the above sketched method, the exposure gain, required to discharge with an all-pixels-on pattern to the potential after exposure, is determined:

$$V_E=V_{SAT}-1/4 (V_{DEV}+V_{CL})$$

The factors 1/4 and 5/4 are introduced to determine the operation point for the potential after exposure $V_E$ in function of the charge potential $V_C$, in order to keep the relative discharge approximately equal. The factor 1/4 may more generally be chosen within the range [1/8,1/2]; the factor 5/4 changes accordingly.

The factor of 1/4, may also be dependent on environmental conditions, as described below.

Definition of terms (see FIG. 1)

The charge potential ($V_C$ 23) of the OPC is defined as the surface voltage with respect to ground after charging the OPC by means of a charging device 2 such as a scorotron and in absence of any exposure to light. The charge potential may be measured by a contact-less electrostatic voltage sensor such as a TREK model 856.

The potential after exposure or discharge potential ($V_E$ 27) is defined as the surface voltage of the OPC with respect to ground after charging the OPC followed by exposure $E_{EXP}$. The potential after exposure may be measured by a contact-less electrostatic voltage sensor such as a TREK model 856

The bias potential ($V_B$ 29) is the voltage of the sleeve of the magnetic roller 8 of the developing unit 5, with respect to ground.

The development potential ($V_{DEV}$ 30) is the difference $V_{DEV}=V_E-V_B$ between the potential after exposure $V_E$27 and the bias potential $V_B$ 29. When this value is negative, it is regarded as 'not-developing' and considered as set to a value of 0.

The cleaning potential ($V_{CL}$) is the difference $V_{CL}=V_B-V_C$ between the bias potential $V_B$ and the charge potential $V_C$ and is preferentially regarded as a fixed value.

the saturation potential ($V_{SAT}$) is the residual potential on the OPC, after a charge cycle followed by exposure with a limitless intensity value $E_{EXP}$. For every charge potential $V_C$ there is a constant value for $V_{SAT}$.

toner supply (TS): the amount of toner supplied to the developing gap 28 per second. TS is dependent on toner concentration TC, doctor blade distance, speed of the magnetic roller 8, etc.

toner concentration (TC): ratio of amount of toner to amount of carrier in the developing unit 5.

PID controller: Proportional, Integral and Differential controller, referring to a general control method, incorporating one, two or three of these techniques, as described in 'Modern Control Engineering' by K. Ogata, Prentice-Hall, Inc., Englewood Cliffs, N.J.

Overall control strategy and operating point definition

Figure 3:
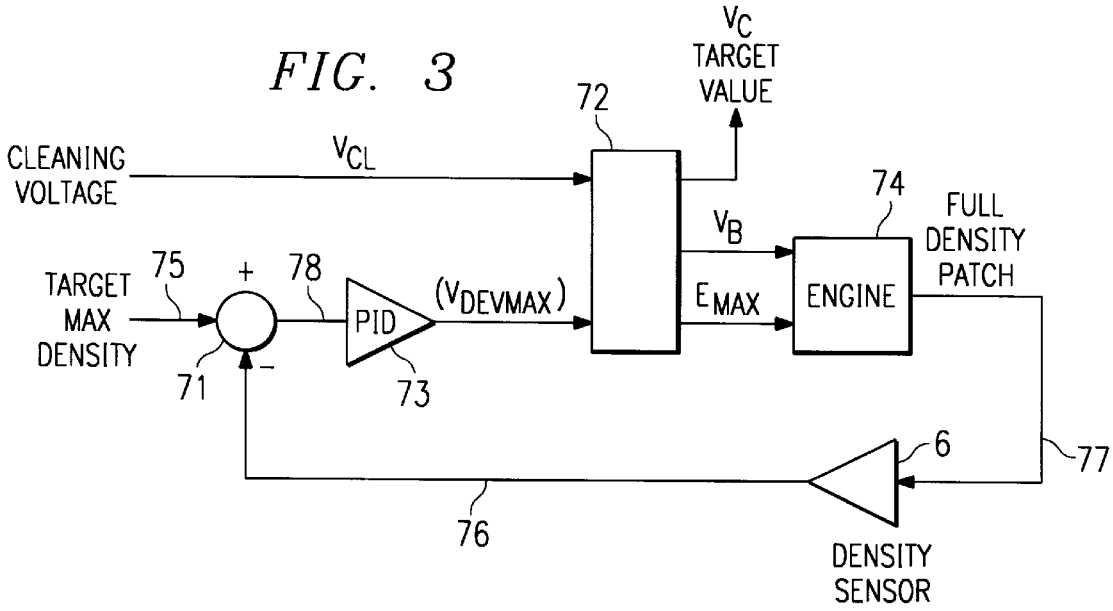
FIG. 3 gives a schematic representation of the maximum density control principle.

In order to fully understand the concepts of the invention, it is important to describe the global process control subsystem that encapsulates these concepts. Referring to FIG. 3, the main goal for the process control subsystem is trying to maintain the required maximum density. To achieve this the engine 74 develops a small rectangular image or patch, in which every pixel is given the same exposure intensity $E_{EXP}$. Such a patch 77 is referred to as a full density patch. The density 76 of the full density patch on the photosensitive element 1 is measured by the density sensor 6 and compared with the target maximum density 75 by means of the comparator 71, generating an error signal 78. This error signal 78 is input to a controller 73, such as a PID controller which computes the required development potential $(V_{DEV})_{MAX}$ to achieve the maximum density 75 of the full density patch 77. From this required development potential, referred to as $(V_{DEV})_{MAX}$, the process controller 72 computes the required values for the charge potential $V_C$, the bias voltage $V_B$ and the maximum exposure energy level $E_{MAX}$. It thereby uses the following rules:

a fixed value is set for the cleaning potential $V_{CL}$ leading to the restriction that:

$$V_{CL}=V_B-V_C \tag{1}$$

since $V_{DEV}=V_E-V_B$, the required $(V_{DEV})_{MAX}$ value leads to:

$$(V_{DEV})_{MAX}=(V_E)_{MAX}-V_B \tag{2}$$

the discharge characteristics of an OPC obey the following mathematical law, wherein $E_{REF}$ is a relaxation constant typical for a certain type of OPC:

$$(V_E)_{\mathrm{MAX}} = V_{SAT} + (V_C - V_{SAT}) \cdot e^{\frac{E_{\mathrm{MAX}}}{E_{REF}}} \tag{3}$$

$(V_E)_{MAX}$, which is the value of the potential after exposure $V_E$ to a maximum exposure energy level of $E_{EXP}=E_{MAX}$, i.e. the exposure intensity $E_{EXP}$ needed for $(V_{DEV})_{MAX}$, has to conform with the following restriction $$\frac{(V_E)_{\mathrm{MAX}} - V_{SAT}}{V_C - V_{SAT}} = K \tag{4}$$

The above restriction is referred to as the K-rule. K is a measure for indicating how close to full saturation the OPC is discharged for obtaining the maximum density, wherein 0<K<1, 0 being the closest to saturation. K is set at a value low enough for getting far enough into full discharge. High enough in order not to waste light energy. Typically K is set at a value around 0.2, or 0.25 as in the previous embodiment. The set of expressions (1) to (4), contains four unknown variables i.e.: $V_C$, $V_B$, $(V_E)_{MAX}$ and $E_{MAX}$. This set of equations therefore has only one solution, defining the operating point of the engine.

The solution for the charge voltage $V_C$ is the required charge voltage of the OPC. To achieve this voltage $V_C$ the charging device 2 or scorotron must be set at a specific voltage $V_{GRID}$. It is described below in accordance with FIG. 4 how $V_{GRID}$ may be set in order to effectively achieve the required charge potential $V_C$ on the photosensitive element.

The solution for the bias voltage $V_B$ gives the bias voltage to be applied directly to the toner supply roller.

The solution $E_{MAX}$ gives the maximum exposure energy level to be generated by the exposure device 3 in order to achieve the full density patch 77. This energy level $E_{MAX}$ may be realised by electrical voltage control or electrical current control of the exposure device 3, by amplitude modulation of the electrical signal or by time modulation, or other techniques that are well known in the art.

The solution $(V_E)_{MAX}$ may not be controlled explicitly, since it is coupled to the other substantial variables via discharge characteristics of the photosensitive element as modeled by the mathematical law (3).

Figure 5:
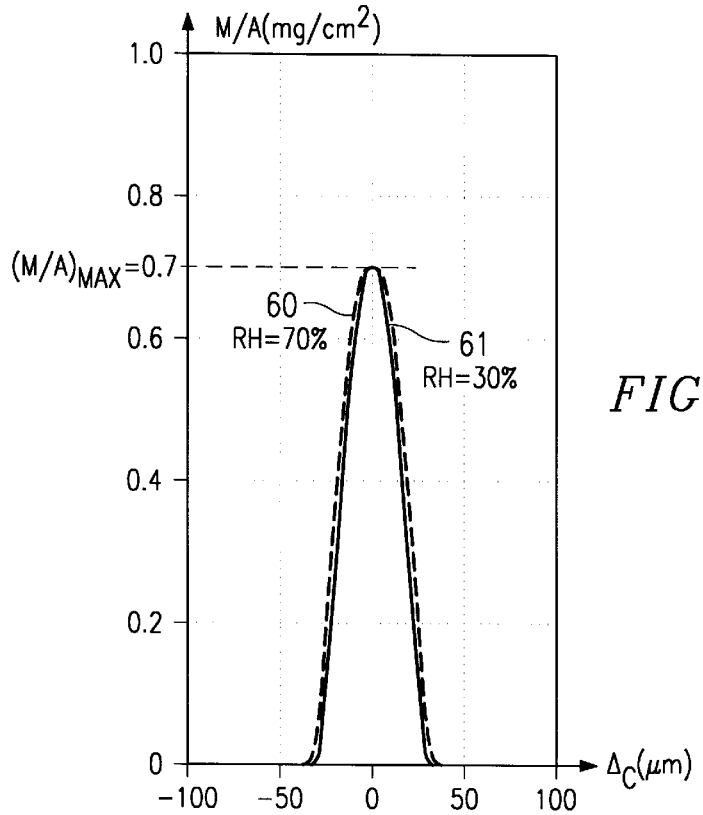
FIG. 5 shows two pixel profiles of deposited mass for one pixel for relative humidity RH=30% and RH=70% respectively, when a constant K-rule is applied and constant toner charge.
Figure 6:
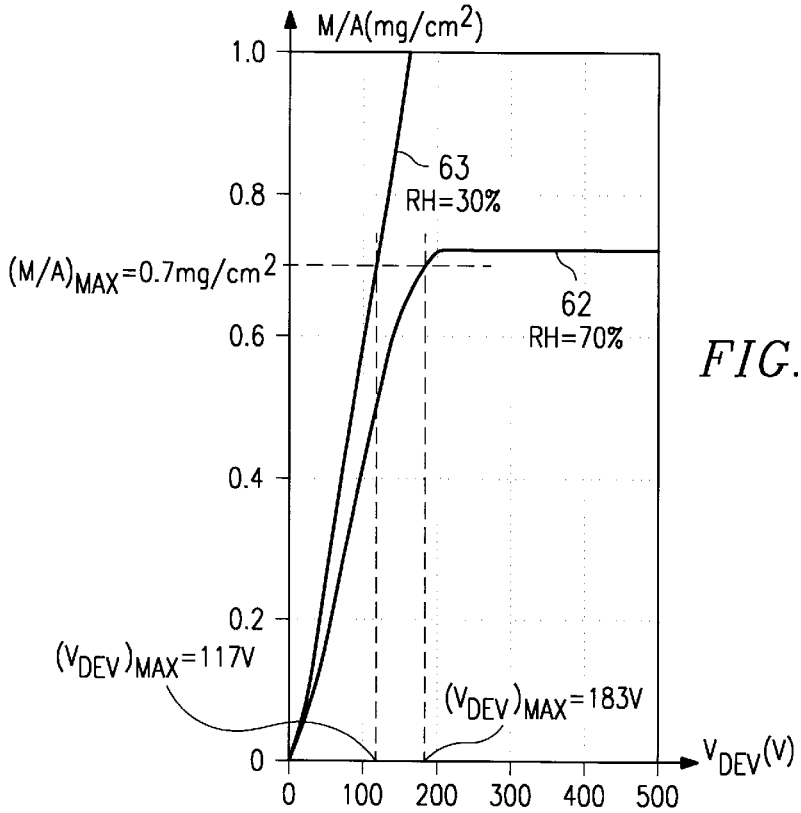
FIG. 6 shows two development curves, for a relative humidity RH=30% and RH=70% respectively and constant toner charge.
Figure 7:
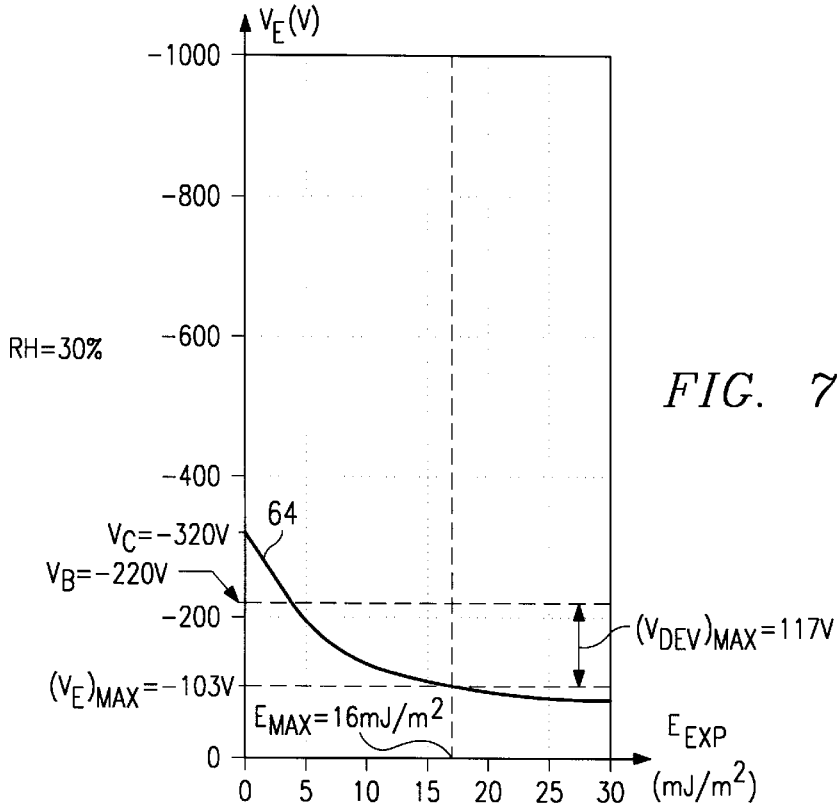
FIG. 7 shows the optimal working point ($V_C$, $V_B$, $(V_E)_{MAX}$, $E_{MAX}$) according to a method of the current invention for a relative humidity RH=30% and constant K-rule.

By applying a K-rule, the point of discharge at maximum exposure energy $E_{MAX}$ is always put on the same relative position of the sensitometric curve of the OPC. This gives some improvement on the control of changes in pixel size as illustrated in FIG. 5, FIG. 6, FIG. 7 and FIG. 8:

FIG. 5 shows a profile 60 and 61 of deposited mass for one pixel;

FIG. 6 shows two development curves 62, 63;

FIG. 7 shows the discharge curve 64 of the OPC at a relative humidity RH=30%, along with the bias voltage $V_B$=−220 V on the vertical axis and the corresponding maximum exposure energy level $E_{MAX}$=16 mJ/m$^2$ on the horizontal axis.

Figure 8:
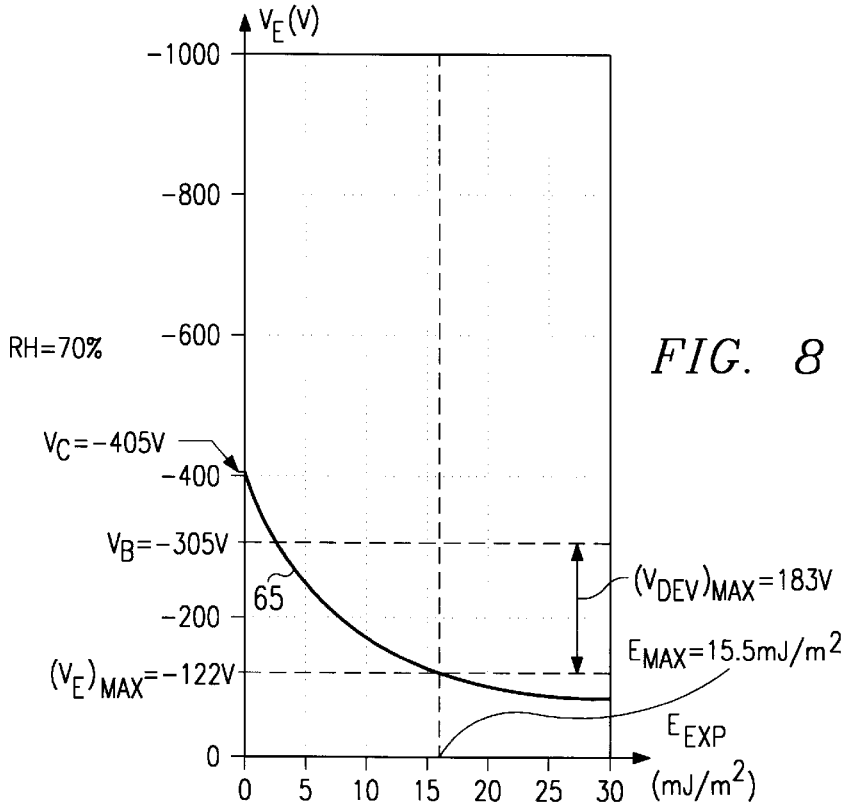
FIG. 8 shows the optimal working point ($V_C$, $V_B$, $(V_E)_{MAX}$, $E_{MAX}$) according to a method of the current invention for a relative humidity RE=70% and constant K-rule.

FIG. 8 shows the discharge curve 65 of the OPC at a relative humidity RH=70%, along with the bias voltage $V_B$=−305 V on the vertical axis and the corresponding maximum exposure energy level $E_{MAX}$=15.5 mJ/m$^2$ on the horizontal axis.

According to FIG. 5, a maximum deposited toner mass $(M/A)_{MAX}$=0.7 mg/cm$^2$ is selected to achieve the maximum microscopic density.

FIG. 6 shows two development curves $M/A=f(V_{DEV})$. The first and steepest development curve 63 corresponds to development achieved at a relative humidity RH=30%. From curve 63 it can be derived that in order to achieve a deposited toner mass $(M/A)_{MAX}$=0.7 mg/cm$^2$, at a relative humidity RH=30%, the development potential must have a value of $(V_{DEV})_{MAX}$ 117 V. Since:

$(V_{DEV})_{MAX}$=117 V is known, the value for the cleaning voltage $V_{CL}$ being independently selected for optimal system performance; and the saturation potential $V_{SAT}$ and the relaxation constant $E_{REF}$ being fixed by the system configuration, and since a fixed value for K in the K-rule is selected, the four unknown variables:

$V_C$: the charge potential;

$V_B$: the bias potential;

$(V_E)_{MAX}$: the maximum potential after exposure; and, $E_{MAX}$: the maximum exposure energy level to achieve the required maximum density level or the maximum deposited toner mass $(M/A)_{MAX}$ may be computed by solving the above set of equations (1) to (4).

For $(V_{DEV})_{MAX}$=117 V, the following values are obtained $V_C$=−320 V;

$V_B$=−220 V;

$(V_E)_{MAX}=(V_{DEV})_{MAX}+V_B$=−103 V; and, $E_{MAX}$=16 mJ/m$^2$.

Figure 9:
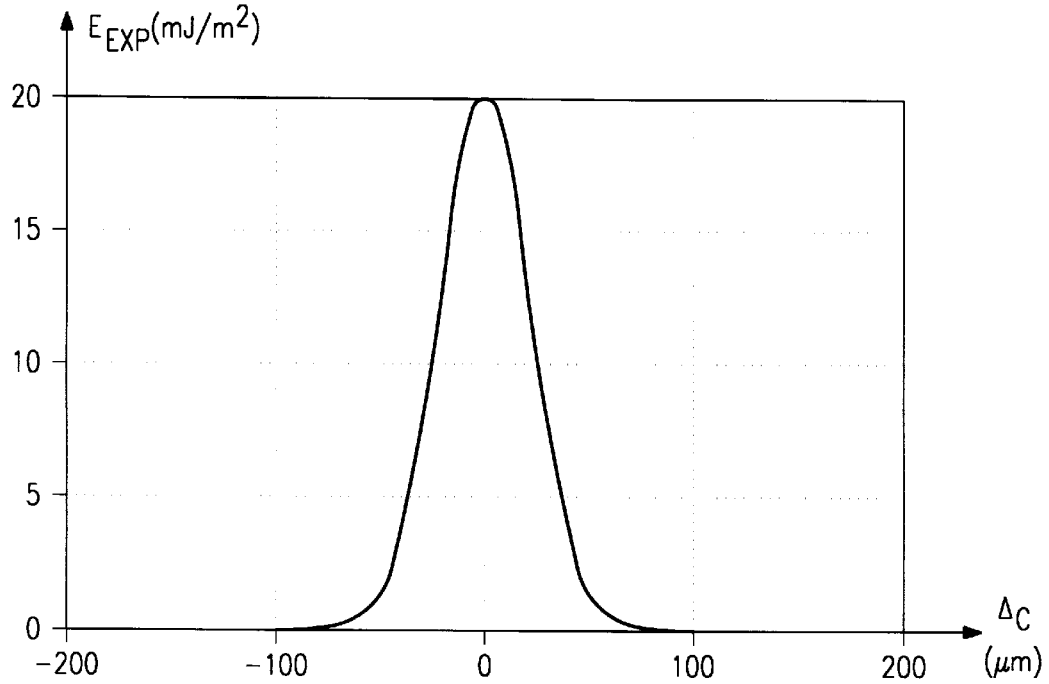
FIG. 9 shows the spatial energy distribution $E_{EXP}$ as a function of the distance $\Delta_C$ from the pixel centre for a gaussian spot.
Figure 10:
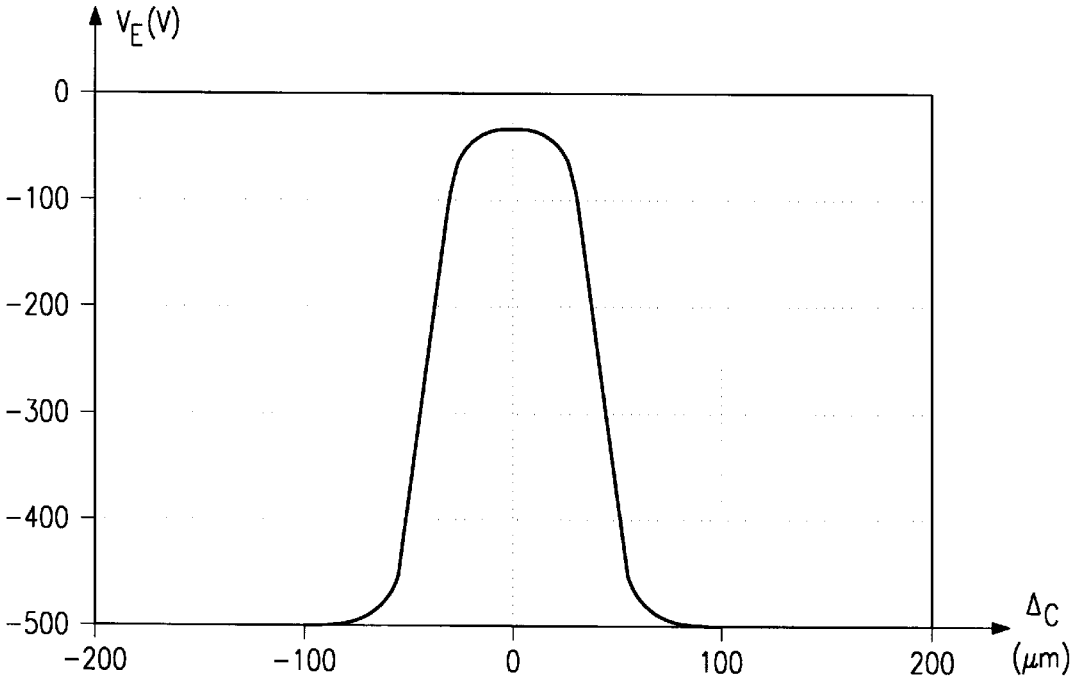
FIG. 10 shows the resulting discharge potential $V_E$ profile across a pixel as a function of the distance $\Delta_C$ from the pixel centre.
Figure 11:
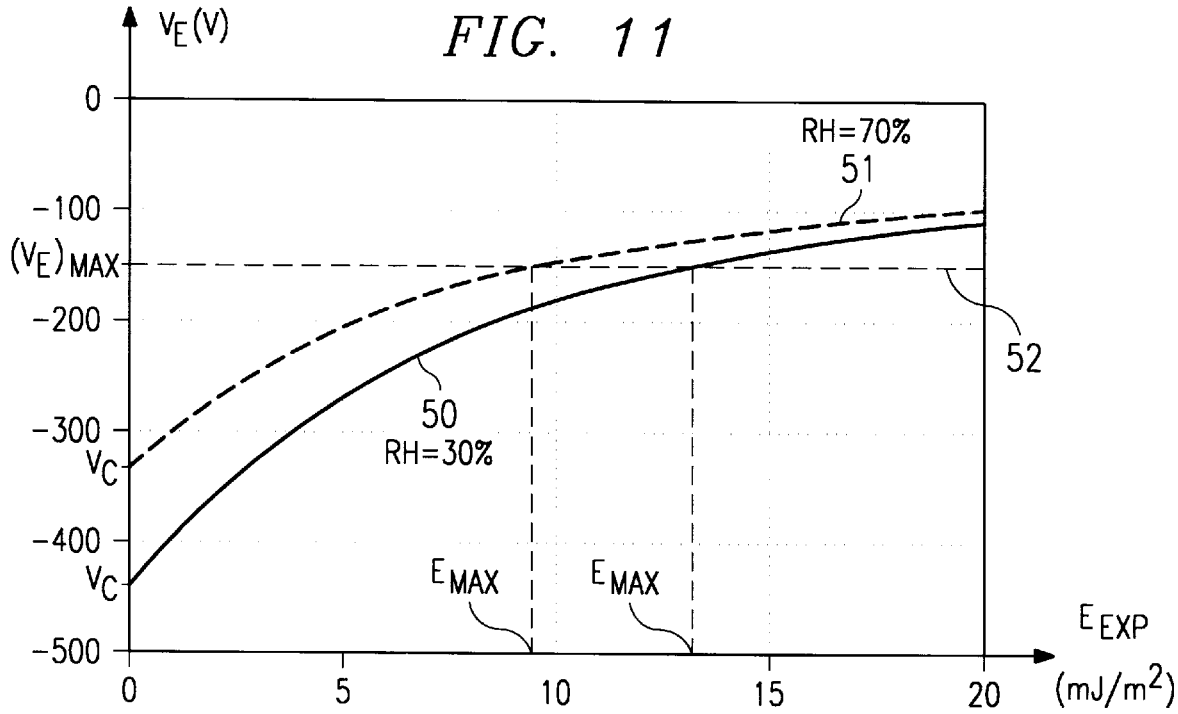
FIG. 11 shows two discharge curves for a typical OPC at two different charge potentials $V_C$ and for two different relative humidities RH and constant toner charge.

The above values are represented in FIG. 7, which shows the preferred discharge curve 64 for a relative humidity RH=30%. The electrophotographic engine according to the current invention, working under the above mentioned conditions, i.e. with the given values for $V_C$, $V_B$ and $E_{MAX}$ and at a relative humidity RH=30%, will produce a microdot having a profile as shown in FIG. 5 by the curve 61. Since, according to the spatial energy distribution profile shown in FIG. 9, the maximum exposure $E_{MAX}$ is only applied to the centre of the microdot, the maximum required toner mass $(M/A)_{MAX}$ will be present only at the centre of the microdot, or at the place where the distance from the pixel centre $\Delta_C$=0 μm. Since, as shown in FIG. 9, the intensity of the light beam decays towards the borders of the microdot, the deposited toner mass M/A also decreases if the distance from the pixel centre $\Delta_C$ increases, and no toner mass is deposited at a distance larger than 25 μm from the centre of the pixel or microdot.

In order to assess what happens at a relative humidity RH=70%, one may start from the second development curve 62 in FIG. 6. From this development curve 62, it is clear that the maximum required toner mass $(M/A)_{MAX}$=0.7 mg/cm$^2$ may be achieved too, but now a larger maximum development potential $(V_{DEV})_{MAX}$ is required. From curve 62 in FIG. 6 it follows that $(V_{DEV})_{MAX}$=183 V at a relative humidity RH=70% in order to achieve a required maximum deposited toner mass $(M/A)_{MAX}$=0.7 mg/cm$^2$. As described above, with this value of $(V_{DEV})_{MAX}$=183 V and with the same K-value as above, the set of four equations (1) to (4) may be solved to give the following results, which are visualised on the discharge curve 65 in FIG. 8:

$V_C$=−405 V;

$V_B$=−305 V;

$(V_E)_{MAX}=(V_{DEV})_{MAX}+V_B$=−122 V; and, $E_{MAX}$=15.5 mJ/m$^2$.

With the above settings and at a relative humidity RH=70%, a microdot may be imaged by the engine. This gives a profile 60 as shown in FIG. 5. Again as for profile 61, the maximum deposited toner mass is achieved only in the centre of the pixel, whereas the deposited toner mass M/A decays towards the borders of the pixel.

Figure 12:
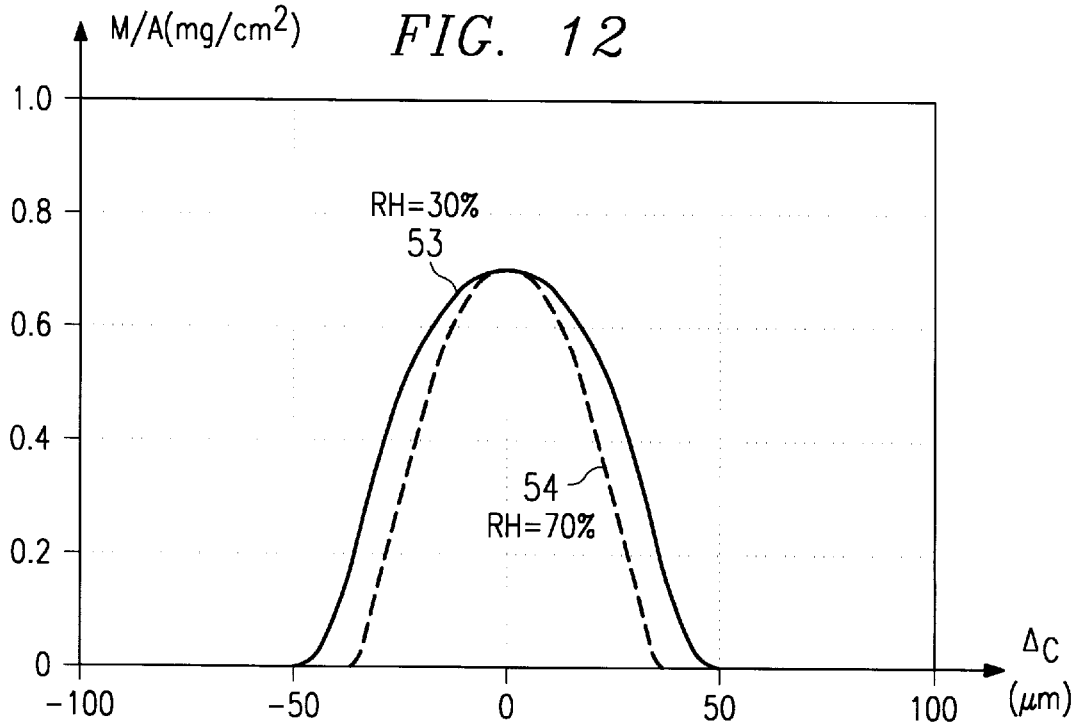
FIG. 12 shows the spatial concentration of toner mass M/A as a function of the distance $\Delta_C$ from the pixel centre for an electrophotographic device operating at different relative humidity with the discharge level at maximum.

As one can see in FIG. 5, the change in pixel size is less conspicuous than the change in pixel size as shown in FIG. 12, but for high quality printing engines the change in pixel size is still not acceptable.

Therefore, in a preferred embodiment, K is not kept constant but made dependent on the relative humidity RH or charge potential:

$$K=f(RH, Vc) \tag{5}$$

Figure 13:
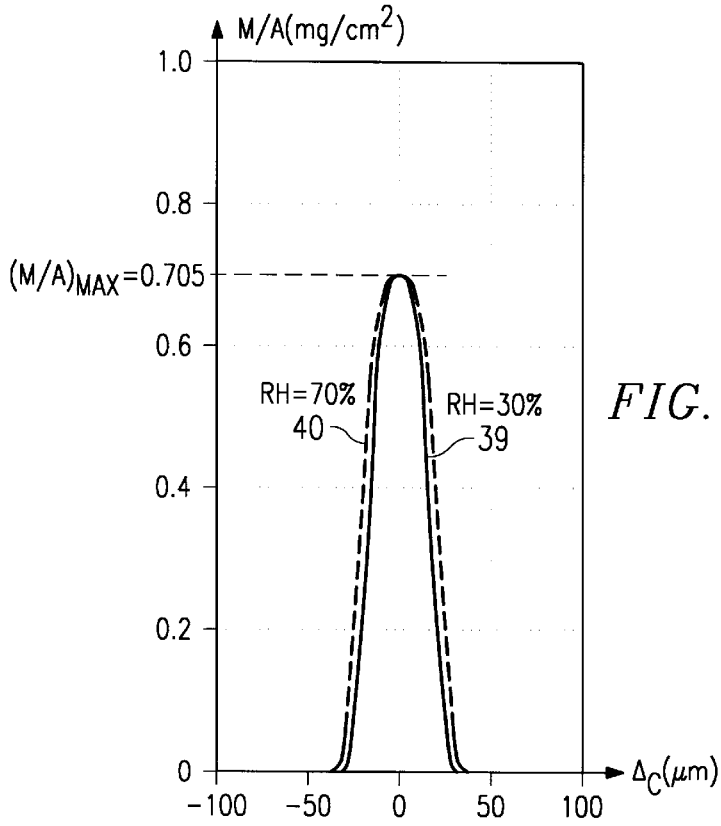
FIG. 13 shows two pixel profiles of deposited mass for one pixel for relative humidity RH=30% and RH=70% respectively, when a variable K-rule is applied and constant toner charge.

This gives a significant improvement on the control of pixel size as illustrated in FIG. 13. The relationship f in expression 5 can be determined experimentally, the criterium being substantially constant pixel size in the final image, at any relative humidity RH. In the current embodiment, the rule used for the result in FIG. 13 is:

$$K=0.2+0.0038\ .(RH-50)$$

Figure 14:
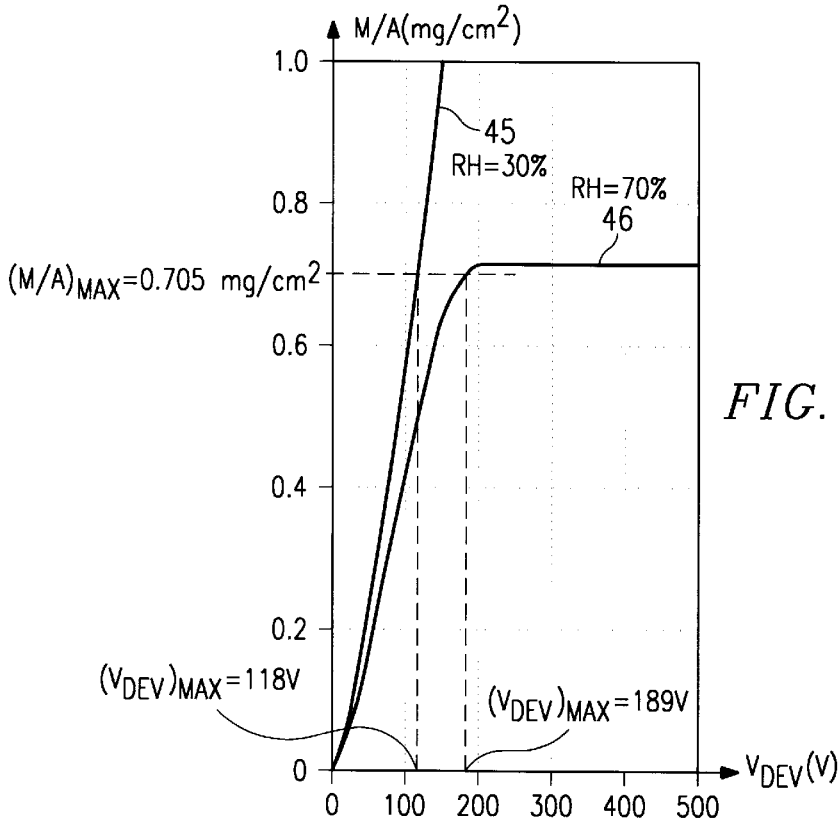
FIG. 14 shows two development curves, for a relative humidity RH=30% and RE=70% respectively and constant toner charge.

To achieve the results shown in FIG. 13, the same procedure as sketched above in conjunction with FIG. 5, 6, 7 and 8 is used. In order to achieve $(M/A)_{MAX}$=0.705 mg/cm$^2$, as shown on top of the curves for the pixel profiles 39 and 40 for RH=30% and RH=70% respectively, the required $(V_{DEV})_{MAX}$ may be derived from the development curves 45 and 46, shown in FIG. 14, representative for the toner mass M/A as a function of the development potential $V_{DEV}$ for a device operating at a relative humidity RH=30% and RH=70% respectively. As shown on FIG. 14, in order to achieve $(M/A)_{MAX}$=0.705 mg/cm$^2$, the development potentials as shown below are required:

$(V_{DEV})_{MAX}$=118 V for the device operating at RH=30%; and, $(V_{DEV})_{MAX}$=189 V for the device operating at RH=70%.

With $(V_{DEV})_{MAX}$=118 V and with K=0.2+0.0038 *(30−50)=0.124, the above equations (1) to (4) are solved and give as solution;

$V_C$=−310 V;

$V_B$=−210 V;

$(V_E)_{MAX}=(V_{DEV})_{MAX}+V_B$=−92 V; and, $E_{MAX}$32 20 mJ/m$^2$.

Figure 15:
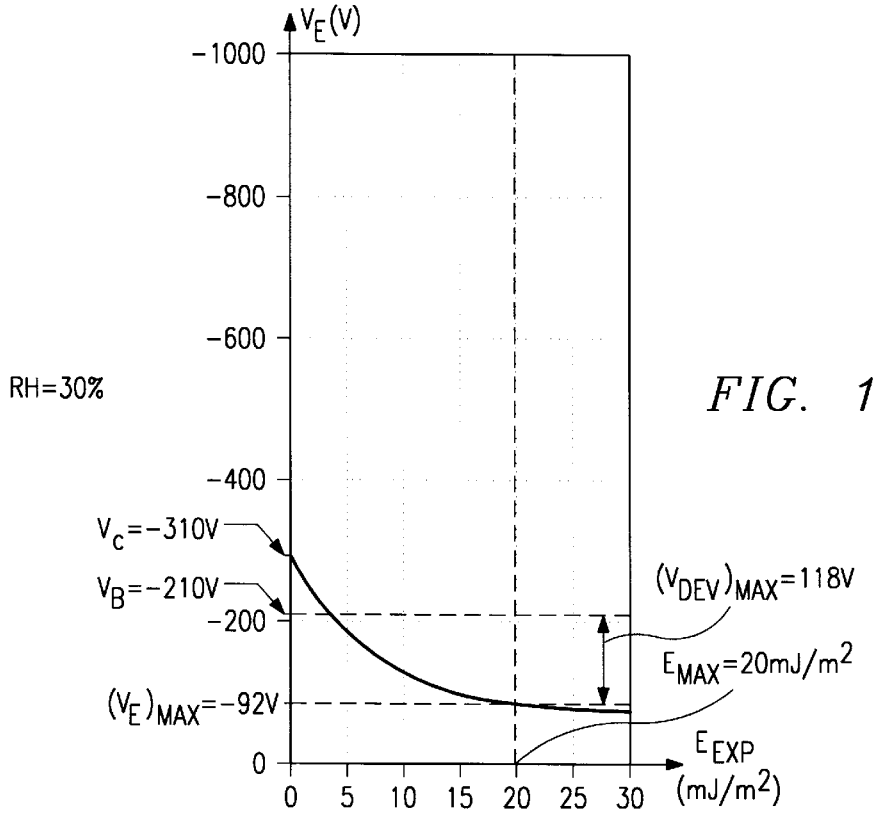
FIG. 15 shows the optimal working point ($V_C$, $V_B$, $(V_E)_{MAX}$, $E_{MAX}$) according to a method of the current invention for a relative humidity RH=30% and variable K-rule

This situation, according to a relative humidity RH=30%, is represented in FIG. 15.

Figure 16:
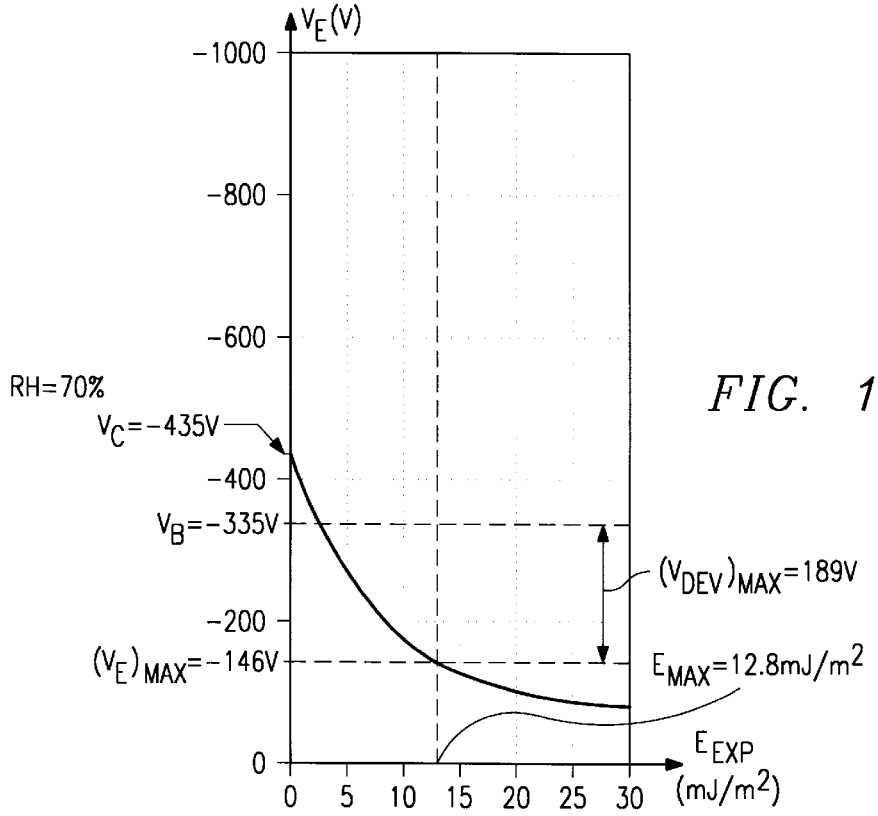
FIG. 16 shows the optimal working point ($V_C$, $V_B$, $(V_E)_{MAX}$, $E_{MAX}$) according to a method of the current invention for a relative humidity RH=70% and variable K-rule.

For a relative humidity RH=70%, according to a preferred embodiment of the current invention, the set of four equations is solved with another K-value, i.e. K=0.2+0.0038 *(70−50)=0.276 and, according to FIG. 14, with $(V_{DEV})_{MAX}$=189 V. The solution of the equations is given below and represented in FIG. 16:

$V_C$=−435 V;

$V_B$=−335 V;

$(V_E)_{MAX}=(V_{DEV})_{MAX}+V_B$=−146 V; and, $E_{MAX}$=12.8 mJ/m$^2$.

The value of K has thus an important influence on the operating point of the process. The resulting profiles are shown in FIG. 13. It is clear that the profiles at relative humidity RH=30% and RH=70% are almost equal, which results in a stable reproduction process, even for a relative humidity varying within a wide range.

Figure 4:
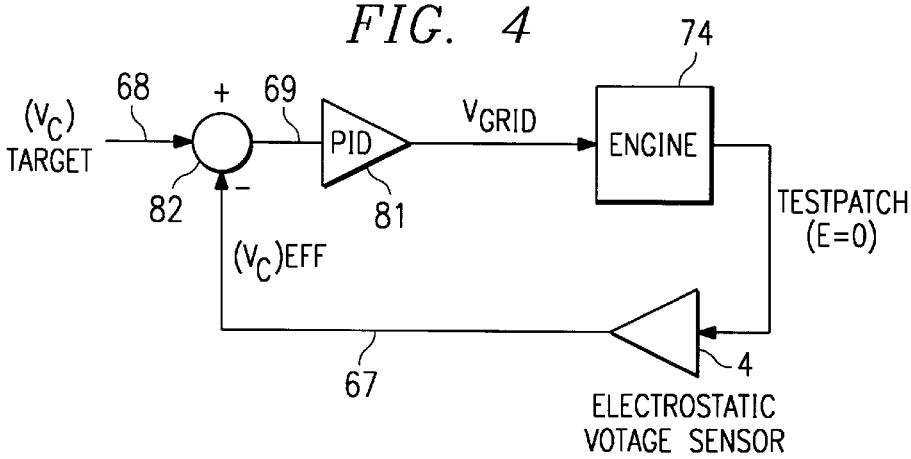
FIG. 4 gives a schematic representation of the control principle to achieve the required charge voltage ($V_C$) target.

The required charge potential $V_C$ on the photosensitive element is controlled preferentially by means of a closed loop control system as shown in FIG. 4. The OPC is charged by the scorotron 2 to a charge voltage level $V_C$. No energy is applied to the OPC by the exposure device 3, such that the OPC is not discharged and keeps the voltage $V_C$. By means of the electrostatic voltage sensor 4 the effective charge level $(V_C)_{eff}$ 67 on the photosensitive element is measured and compared by means of the comparator 82 to the target value $(V_C)_{target}$ 68. This target value $(V_C)_{target}$ is preferentially computed by the above described control algorithm based on equations (1)–(4). The resulting error signal 69 is input to a PID controller 81, calculating the required value for $V_{GRID}$. $V_{GRID}$ is the voltage applied to the grid of the charging device 2 (scorotron), in order to achieve the target charge potential.

Having described in detail preferred embodiments of the current invention, it will now be apparent to those skilled in the art that numerous modifications can be made therein without departing from the scope of the invention as defined in the following claims.

What is claimed is:

1. A method for achieving a consistent patch of maximum optical density on a photoconductive element, comprising the steps of:

establishing a maximum development potential $(V_{DEV})_{MAX}$ to achieve said required maximum optical density;

establishing a relation between maximum discharge voltage $(V_E)_{MAX}$, charge voltage $V_C$, and saturation voltage $V_{SAT}$ of said photoconductive element, indicative for how close to saturation $V_{SAT}$ said photoconductive element is discharged from $V_C$ to $(V_E)_{MAX}$ by application of exposure energy $E_{EXP}$ to said photoconductive element;

based on said relation and on said maximum development potential $(V_{DEV})_{MAX}$, computing said maximum discharge voltage $(V_E)_{MAX}$, and a corresponding maximum exposure energy level $E_{MAX}$ for exposing said photoconductive element; and applying toner to said photoconductive element charged at charge voltage level $V_C$ and exposed to an energy level $E_{MAX}$ to achieve said patch of maximum optical density.

2. Method according to claim 1, wherein said relation comprises a factor K which is a function of environmental relative humidity RH.

3. Method according to claim 2, wherein said function is a linear function.

4. Method according to claim 1, further comprising the steps of:

charging said photoconductive element by applying a scorotron voltage to a scorotron, positioned close to said photoconductive element;

measuring the effective charge level $(V_C)_{eff}$ of said photoconductive element;

comparing said effective charge level $(V_C)_{eff}$ to a required charge level $(V_C)_{RQ}$; and modifying said scorotron voltage as a result of said comparing step.

5. Method according to claim 1, comprising the step of exposing a plurality of patches on said photoconductive element to different exposure levels $E_{EXPi}$, constant within each patch.

6. Method according to claim 5, further comprising the steps of:

developing said patches by application of toner;

measuring the optical density of each patch by a densitometer; and establishing a conversion table giving exposure level as a function of required optical density, based on said measured optical density.

7. Method according to claim 5, further comprising the steps of:

measuring the voltage level of said exposed patches; and establishing a conversion table giving exposure level as a function of required optical density, based on said measured voltage level.

* * * * *